United States Patent [19]

Brooks et al.

[11] Patent Number: 4,610,282

[45] Date of Patent: Sep. 9, 1986

[54] LIQUID CARBONATING APPARATUS

[75] Inventors: Graham L. Brooks; Antony F. Pateman; Michael A. Thomson, all of Peterborough; John Scott, Huntingdon, all of England

[73] Assignee: Sodastream Limited, Woodston, England

[21] Appl. No.: 678,544

[22] PCT Filed: Apr. 3, 1984

[86] PCT No.: PCT/GB84/00115

§ 371 Date: Nov. 27, 1984

§ 102(e) Date: Nov. 27, 1984

[87] PCT Pub. No.: WO84/04024

PCT Pub. Date: Oct. 25, 1984

[30] Foreign Application Priority Data

| | | | |
|---|---|---|---|
| Apr. 8, 1983 | [GB] | United Kingdom | 8309627 |
| Sep. 2, 1983 | [GB] | United Kingdom | 8323594 |
| Nov. 21, 1983 | [GB] | United Kingdom | 8331000 |

[51] Int. Cl.[4] ..... B65B 3/04

[52] U.S. Cl. ..... 141/46; 99/375; 261/DIG. 7; 426/477; 215/11 B; 222/85; 277/27; 251/89; 251/99

[58] Field of Search ..... 141/1-12, 141/14-17, 37-70; 99/375, 323.1, 323.2; 261/DIG. 7; 426/477, 312, 316, 397; 215/11 B, 307, 311; 222/85; 277/27; 137/625.25; 251/89, 98, 99

[56] References Cited

U.S. PATENT DOCUMENTS

| | | | |
|---|---|---|---|
| 4,298,551 | 11/1981 | Adolfsson et al. | 261/DIG. 7 |
| 4,342,710 | 8/1982 | Adolfsson et al. | 426/477 |
| 4,481,986 | 11/1984 | Meyers | 141/4 |

FOREIGN PATENT DOCUMENTS

| | | |
|---|---|---|
| 461164 | 2/1937 | United Kingdom . |
| 1468469 | 3/1977 | United Kingdom . |

*Primary Examiner*—Houston S. Bell, Jr.
*Attorney, Agent, or Firm*—Watson, Cole, Grindle & Watson

[57] ABSTRACT

A portable machine for carbonating liquid contained in a bottle is adapted to support the bottle (5) by the neck (81) through a bayonet connection and for a seal (64) which closes the bottle neck to be driven into engagement with the bottle neck by a piston (60) actuated by the first burst of gas supplied to the injection nozzle (66). The bottle is loaded into the machine through a front opening (6) and a cover (7) for closing the opening is interlocked with a gas supply valve (12) so that gas can only be delivered to the nozzle (66) when the cover is closed. The cover is opened and closed by rotating a knob (23) which is depressed to open the gas valve. The knob (23) is coupled to the gas valve (12) through a device (27) which prevents the valve being opened if the machine is tilted at more than a given angle to the upright position. To prevent an insufficiently filled bottle being pressurized a vent (76) is provided through an element (61) carrying the bottle seal (64) and a float guided on the gas tube (65) carries a valve member (79) to close the vent (76) when a minimum level of liquid is present in the bottle.

38 Claims, 12 Drawing Figures

LIQUID CARBONATING APPARATUS

This invention relates to apparatus for aerating liquids, and more especially a portable apparatus for carbonating water to prepare carbonated drinks.

In one known form of liquid carbonating apparatus the liquid to be carbonated is placed into a bottle and the bottle is loaded into a carbonating machine. A seal member is adapted to engage and seal closed the neck of the bottle, while a tube carrying a gas nozzle extends through the seal member and down into the bottle for injecting carbon dioxide gas into the liquid contained in the bottle. The upper end of the gas tube is connected to a gas cylinder via a valve which is operated manually to supply gas to the injection nozzle. In order to limit the maximum pressure within the bottle an exhaust passage is provided through the seal member and communicates with atmosphere through a relief valve which is arranged to open when the maximum pressure is exceeded.

In general the known carbonating apparatus of the above type operates satisfactorily. It does however suffer from certain drawbacks which the present invention seeks to reduce or eliminate.

Difficulty is sometimes experienced in achieving a satisfactory seal between the bottle and the sealing member, for example as a result of variations in bottle heights due to manufacturing tolerances.

In an attempt to improve the seal between the bottle neck and the seal member, and more particularly to solve the problem of the seal member and the bottle neck becoming forced apart by the pressure generated in the bottle during carbonation so that leakage occurs between the bottle and seal member, it has been proposed to support the seal member on a movable wall member, i.e. a diaphragm or a piston, whose upper surface has an area greater than that of the bottle neck and is exposed to the same pressure as that which exists in the bottle. For this purpose a chamber defined on the upper side of the wall member communicates with the exhaust passage through the seal member. With this arrangement the seal member is pressed down against the bottle neck with increasing force as the gas pressure rises thereby reversing the tendency for the bottle and seal member to move apart. The arrangement is not however without problems. The resultant downward force on the seal member is only obtained once a positive pressure has been created in the chamber above the movable wall and an initial seal is still required between the bottle and the seal member. As the pressure of the first burst of gas injected into the bottle is felt within the bottle neck before it reaches the chamber above the movable wall the initial sealing pressure must be capable of preventing the seal member disengaging the bottle under this burst of pressure. A spring or the natural resilience of the diaphragm may be utilised in an attempt to ensure the initial sealing engagement, but the magnitude of the initial sealing pressure required can lead to the seal member becoming damaged or worn by the bottle loading operation, especially if the bottle happens to be twisted as it is inserted.

It has also been suggested to use an inflatable sealing member which is inserted into the bottle neck and is expanded into sealing engagement with the neck by the pressure of the gas delivered into the bottle. In order to operate correctly only a small initial clearance is allowable between the sealing member and the bottle and since it must be introduced into the bottle neck there is still a danger of it becoming worn and damaged if the bottle is not positioned in accurate alignment with it. An inflatable sealing member is also more complicated and expensive to manufacture.

In accordance with a first aspect the present invention seeks to eliminate the above problems and accordingly there is provided an apparatus for carbonating liquid contained in a bottle comprising sealing means for engaging and sealing closed the neck of the bottle, gas injecting means projecting downwardly from the sealing means for injecting gas into the liquid, means for supporting the bottle in a predetermined position with the neck of the bottle adjacent the seal means and the gas injecting means extending down into the liquid in the bottle, movable wall means carrying the sealing means and movable under the pressure in a chamber defined on the side thereof remote from the sealing means, and wall displacing means actuable to displace the movable wall means downwardly for moving the sealing means, before or as gas is first injected into the bottle, from a position spaced above the bottle neck to a position of firm sealing engagement with said neck.

With such an apparatus the sealing means is easily arranged so that it is spaced a small distance above the bottle neck during insertion of the bottle. This feature is of substantial benefit in that it removes the risk of harming the sealing means when loading the bottle. Before any gas is introduced into the bottle, or at least as the first burst of gas enters the bottle, the sealing means is driven into engagement with the bottle neck to establish an effective initial seal.

The wall displacing means could be operated mechanically, but according to a preferred embodiment the wall displacing means is responsive to an initial burst of gas supplied to the gas injecting means. In the preferred embodiment the wall displacing means comprises a piston attached to the movable wall member. With such an arrangement the seal between the sealing means and the bottle neck is effected automatically upon operating the apparatus to supply gas to the injection means and no additional manual operations need to be carried out by an operator.

In the prior art carbonating machines mentioned above the bottles rest on platforms so as to be supported at the bottom. The bottles themselves can vary in height and short bottles may result in a sealing problem while tall bottles can cause damage to the machine.

According to a preferred feature of the present invention the carbonating apparatus includes bottle mounting means fixed in position adjacent the sealing means, the bottle mounting means being engageable by the bottle neck to support the bottle in predetermined position for the sealing means to engage the bottle neck.

By supporting the bottle at the neck it is possible to ensure that an adequate seal will always be made between the sealing means and the neck in spite of any variations in bottle height due to manufacturing tolerances. It also allows bottles of different sizes, in particular of different height, to be used in the apparatus. In addition the design and manufacture of the apparatus may be simplified since the force acting between the sealing means and a bottle support platform does not have to be absorbed by a machine casing.

It is expedient for the bottle to have a bayonet type of coupling to the bottle mounting means. In this case the bottle mounting means preferably comprises a plurality of guide slots formed in a stationary collar arranged to receive the bottle neck, and it is of advantage for the slots to have axially inclined edges to assist in camming a bottle into correct engagement with the collar. Such an arrangement has the added advantage that the apparatus can be used only with the correct bottles and it will not accept other conventional bottles which may not be strong enough, as prior art machines have been known to do.

A bottle provided in accordance with the invention for use with an apparatus as just described, comprises a neck portion with a plurality of integral protrusions spaced apart around the neck portion and projecting outwardly therefrom for cooperation with respective bayonet slots of the mounting collar. The bottle is most conveniently made of plastic material with the neck portion formed by injection moulding or extrusion blow moulding.

Another disadvantage of the prior art carbonating machines of the kind initially described is that they can be operated when tilted at a substantial angle to the vertical whereas it is intended that they should be used only in the upright position. If operated in an inclined condition water can be driven into the exhaust passage and impede the discharge of gas with the result that the pressure in the bottle may exceed the limit pressure set by the relief valve and even reach such a level that the bottle may burst.

This drawback is eliminated in accordance with a second main aspect of the present invention, according to which there is provided a portable liquid carbonating apparatus comprising means for injecting gas into a body of liquid contained in a carbonating vessel, gas supply means for conducting gas to the injecting means from a pressurised gas source, valve means included in the supply means for controlling the flow of gas therethrough and disabling means arranged to prevent the valve means being opened if the apparatus is inclined to a normal operating position in which it is intended to be used by more than a predetermined angle.

The disabling means preferably disables the apparatus from operating if it is inclined at an angle of greater than about 20° from the normal upright position. In one possible construction the disabling means comprises a pendulum suspended from a valve actuating member and adapted to engage a fixed stop to prevent the actuating member being displaced to operate the valve when the inclination exceeds that allowable. In a preferred construction, however, the disabling means comprises a force transmitting member located between a valve actuating member and the gas supply valve means, the force transmitting member being arranged to move out of its normal force transmitting position when the apparatus is tilted. Conveniently the force transmitting member may be a thrust ball interposed between a valve actuating lever and a valve pin which is depressed to open the gas valve means.

An important feature of liquid carbonating machines is that should a bottle burst in the machine it should not lead to the machine exploding or cause injury to the operator. It is possible for a bottle to burst when pressurised within a carbonating machine, for example if the bottle is weak or damaged, but in general the prior art machines are designed to withstand such bottle failures and the risk of injury to an operator is very low, the amount of pressurised gas within a correctly filled bottle being relatively small. If a bottle is empty or contains very little water, however, the amount of pressurised gas is substantially increased especially in the case of large capacity bottles, and the potential danger is increased correspondingly.

With a view to reducing these dangers the present invention provides in accordance with a further aspect an apparatus for carbonating liquid contained in a bottle comprising sealing means for engaging and sealing closed the neck of the bottle, gas injecting means extending downwardly from the sealing means for injecting gas into the liquid, a vent passage extending through the sealing means for communicating the interior of the bottle with atmosphere when the sealing means is engaged with the neck thereof, and valve means responsive to the level of liquid in the bottle and arranged to close the vent passage only if a predetermined level of liquid is present in the bottle.

With an apparatus of this form bottles of comparatively large capacity, e.g. 1 liter, may be used with complete safety. It is impossible to pressurise a bottle which is either empty or holds only a small amount of water since the gas entering the bottle will escape directly to atmosphere via the vent passage. In a preferred construction the valve means comprises a valve seat on the sealing means and a valve member carried by a float for movement into and out of engagement with the seat. Conveniently the float is guided for movement towards and away from the valve seat by a gas tube forming part of the gas injecting means.

Yet another drawback suffered by the prior art carbonating machines of the kind initially described is that the gas valve can be operated before the machine has been properly closed with the bottle in position.

In accordance with a further aspect the present invention resides in an apparatus for carbonating liquids which is of novel construction, avoids the above drawback and comprises a casing defining an enclosure for receiving a bottle containing liquid to be carbonated, said enclosure including a movable wall member which is adjustable between a first position enabling the bottle to be introduced into and removed from the enclosure, and a second position in which the bottle is substantially enclosed, sealing means for engaging and sealing closed the neck of a bottle received in the enclosure, gas injecting means extending downwardly from the sealing means for injecting gas into the liquid in the bottle, gas supply means for conducting gas to the injecting means from a pressurised gas source, valve means included in the gas supply means for controlling flow of gas to the injecting means, valve actuating means operable to open the valve means, and interlock means coupled between said movable wall and the valve actuating means to enable the valve means to be opened only when the movable wall is in the second position.

A preferred apparatus constructed according to this aspect includes a common operating member for adjusting the movable wall of the enclosure and for actuating the gas valve means. In more detail, the operating member is rotatable for adjusting the movable wall between its first and second positions, and is subject to translational displacement, e.g. depressed to open the gas valve means, the interlock means being arranged to prevent this member being translated except when it occupies the rotational position in which the movable wall is in the second position. The provision of a single operating member simplifies the operation of the apparatus so that it can be easily used even by people who are not familiar with it.

The movable wall of the enclosure may comprise a tubular shield which is raised and lowered between the first and second positions. Alternatively the casing may define a chamber with a side wall opening, and the movable wall may be a cover rotatable relative to the casing to open and close the opening.

A full understanding of the invention in its several aspects will be had from the following detailed description which is given with reference to the accompanying drawings in which.

Figure 1:
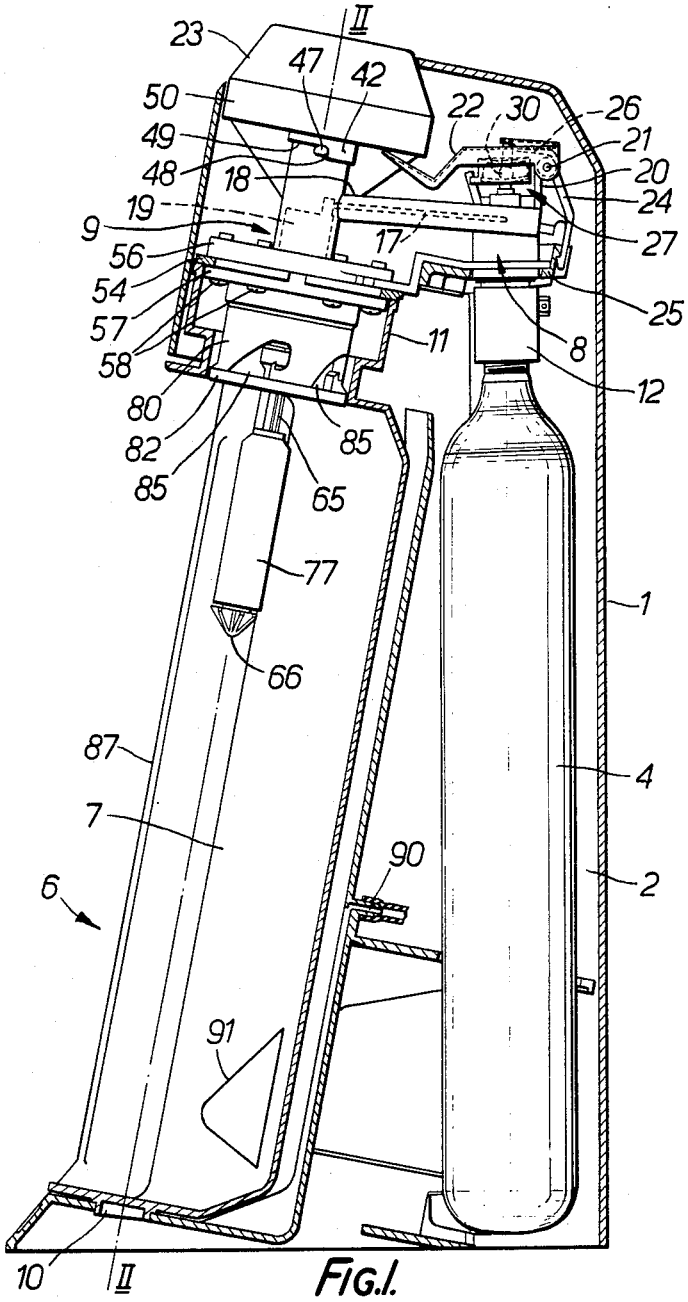
FIG. 1 is a side view shown partly in section of a carbonating apparatus or machine embodying the invention.

Referring to FIGS. 1–4 there is shown a portable liquid carbonating machine having a casing 1 which mounts internally a main support assembly carrying most of the working parts of the machine as will become clear. The casing encloses two compartments or chambers 2,3 for receiving respectively a gas cylinder 4 and a bottle 5 containing liquid to be carbonated. The casing has an opening 6 at the front to enable the bottle 5 to be loaded into and taken out of the machine chamber 3, and a part-cylindrical cover shield 7 is provided for closing the opening 6. The main support assembly includes a first support part 8 located at the top of chamber 2 and a second support part 9 located at the top of chamber 3. The shield 7 is journalled for rotation relative to the casing about an axis which is inclined at a small angle to the vertical, a hub 10 (FIG. 1) provided on a bottom flange of the shield being received rotatably in a hole in the floor of chamber 3 and a cylindrical sleeve 11 attached to the top of the shield being journalled around the support part 9. The shield 7 can thus be rotated between the open position shown in FIG. 1 and the closed position of FIG. 2.

A valve 12 is attached to the top of refillable gas cylinder 4 although it could instead be adapted for connection to a disposable cylinder. The upper end of the valve 12 is screwed into a threaded bore 13 formed in the support part 8, and a pin 14 (FIG. 5) is slidably mounted in a bore 15 formed as an extension of bore 13 and projects from the top of support part 8 to enable it to be pressed down to push down the valve member 16 for opening the gas valve to allow gas to escape under pressure from the cylinder 4. (The actuation of the gas valve 12 is described in more detail below). A duct 17 (FIG. 1) provided through a bridging piece 18 between support parts 8 and 9 connects the bore 13 in part 8 with the upper end portion of a stepped blind bore 19 formed in support part 9. The support part 8 includes a clevis member 20 (FIGS. 1, 5) supporting a pin 21 to which a valve actuating lever 22 is pivoted, lever 22 extending forwardly from pivot pin 21 and having its forward end engaged below an operating knob in the form of a large button 23 which is carried on the body part 9, or shown in FIGS. 1 and 4. Also integral with the support part 8 is a latching hook 24 (FIG. 1) adapted to engage a support frame 25 fixed to the casing 1 for securing the support assembly 8,9 firmly in position in the casing.

Figure 5:
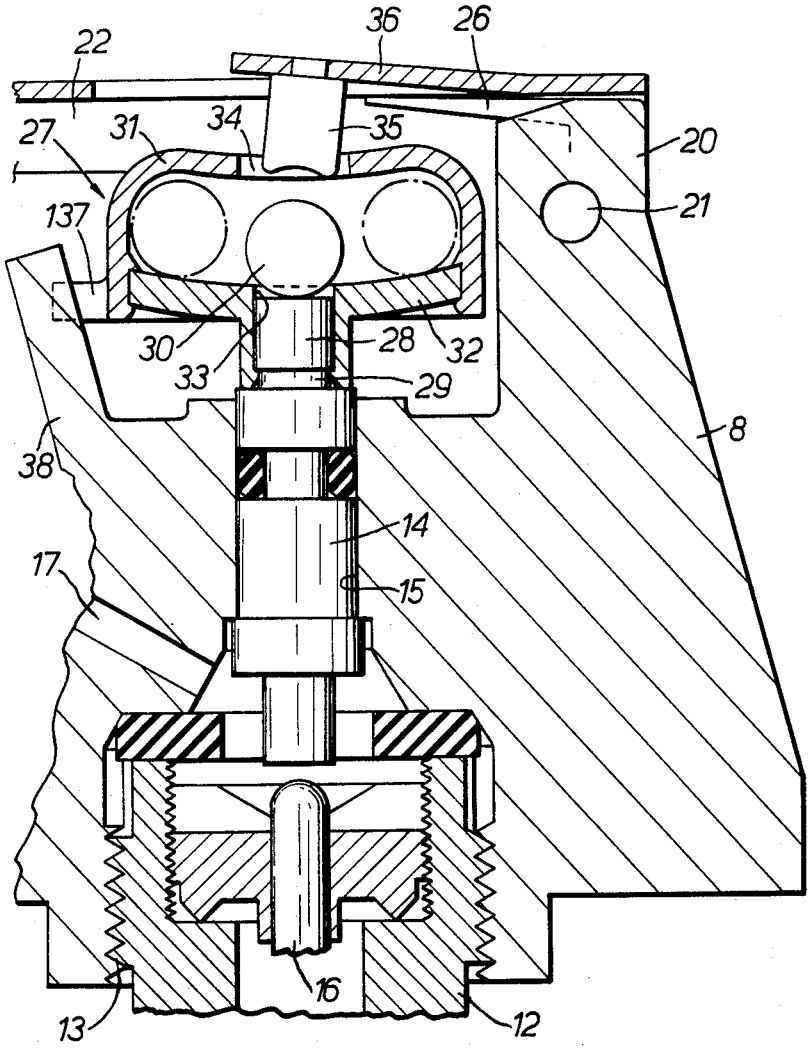
FIG. 5 is a detail view showing on an enlarged scale the gas valve actuating mechanism and a disabling means for preventing the opening of the gas valve when the FIG. 1 apparatus is tilted.

The end of the lever 22 is urged into cooperation with the button 23 by a pair of spring fingers 26 (FIG. 5) which are integrally formed with the support part 8. The lever 22 acts on the pin 14, and hence the valve member 16 through a disabling device 27 which prevents the machine being operated in an inclined position. Referring to FIG. 5 in particular, the upper end of the pin 14 has a head 28 attached by a reduced diameter neck portion 29 and mounted on the head is the disabling device 27. This device consists of a cage accommodating a ball 30. The cage includes a cover 31 having a snap-fit connection on a circular base 32 which has a slightly concave upper surface. The base has an integral spigot which projects downwardly and engages with a snap-fit over the head 28 of the pin 14. The top of the head 28 is located at a small distance below the upper surface of the base to define a shallow recess surrounded by a step 33. The cover 31 has a top opening 34 to enable a cylindrical peg 35 to move through it into abutment with the ball 30. The peg is carried by a tongue 36 integral with lever 22, and is normally held clear of the ball due to the spring fingers 26. In order to accommodate the movement of the peg 35 while not permitting the ball to escape from the cage, the hole 34 is elongated in the direction of the plane of the length of the lever. The cage is retained in the correct rotational position by a pair of teeth 37 on the cover 31 engaging either side of a post 38 fixed on the support part 8.

In the normal upright position of the carbonating machine the ball 30 seats in the recess on top of the head 28 of the pin 14. When the free end of the lever 22 is pivoted down to open the gas valve, the tongue 36 pivots with it and pushes the peg 35 down onto the top of the ball 30. The peg 35, ball 30, pin 14, and valve member 16 can then move downwardly together so that the valve is opened upon downward pivotal movement of lever 22.

If the machine is inclined at such an angle that the ball rolls out of the recess over the step 33, for example to one of the positions illustrated in chain line in the drawing, any downward pivoting of the lever 22 is not transmitted to the pin 14 so that the gas valve remains closed. Thus, only if the machine is substantially upright when the lever 22 is operated will the gas valve be opened to release gas from the cylinder. It is preferred that the disabling device be responsive to an inclination of more than about 20° to the normal upright position.

Figure 6:
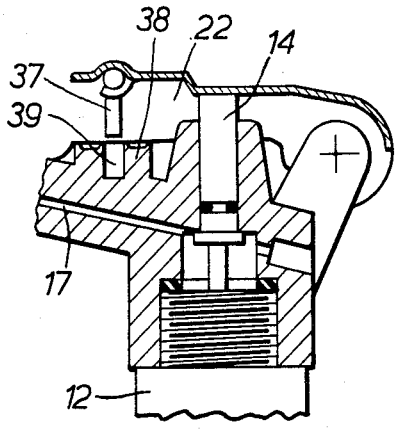
FIG. 6 is a detail view illustrating an alternative form of disabling means to prevent the gas valve being opened when the FIG. 1 machine is tilted.

Other forms of disabling means are possible, for example as illustrated in FIG. 6. Here the lever 22 is arranged to act directly against the upper end of pin 14 and the disabling mechanism comprises a pin-like pendulum 37 carried by the lever and arranged to cooperate with an annular stop 38 fixed on the main support assembly. When the machine is upright and the lever is depressed the pendulum enters the recess 39 at the centre of the stop 38 and the gas valve opens. However, if the machine is tilted at a substantial angle, e.g. by more than 20° the pendulum will abut against the annular stop shoulder 38 to prevent the lever 22 pivoting far enough to open the gas valve. Of course other forms of pendulum and stop are possible and for instance the pendulum may have the form of an inverted cap and be arranged to cooperate with a fixed stop pin.

The support part 9 includes an upstanding cylindrical column 40 having a blind recess 41 in its upper end. The knob 23 has a sleeve 42 which is a sliding fit on the column 40 and a spring 43 accommodated in the recess 41 acts between the support part 9 and the knob to urge the latter to an upper position as shown in FIG. 1 and in the left hand half of FIG. 2. The knob is retained on the column 40 by a key pin 44 which is inserted through the open end of a radially projecting finger 95 integral with the knob 23. The key pin 44 cooperates with a guide groove formed in the outer surface of the column 40. The groove includes an annular first portion 45 (FIG. 4) normal to the axis and a second portion 46 parallel to the axis, as clearly shown in FIG. 2A, whereby the operating knob 23 is guided for rotation relative to the support part 9 and is capable of limited axial movement relative thereto when the pin 44 is aligned with the axial groove portion 46 (as in the right hand half of FIG. 2). When depressed against the force of spring 43, the button 23 bears down on the lever 22 causing it to pivot downwardly to open the gas valve 12.

Figures 2, 2A:
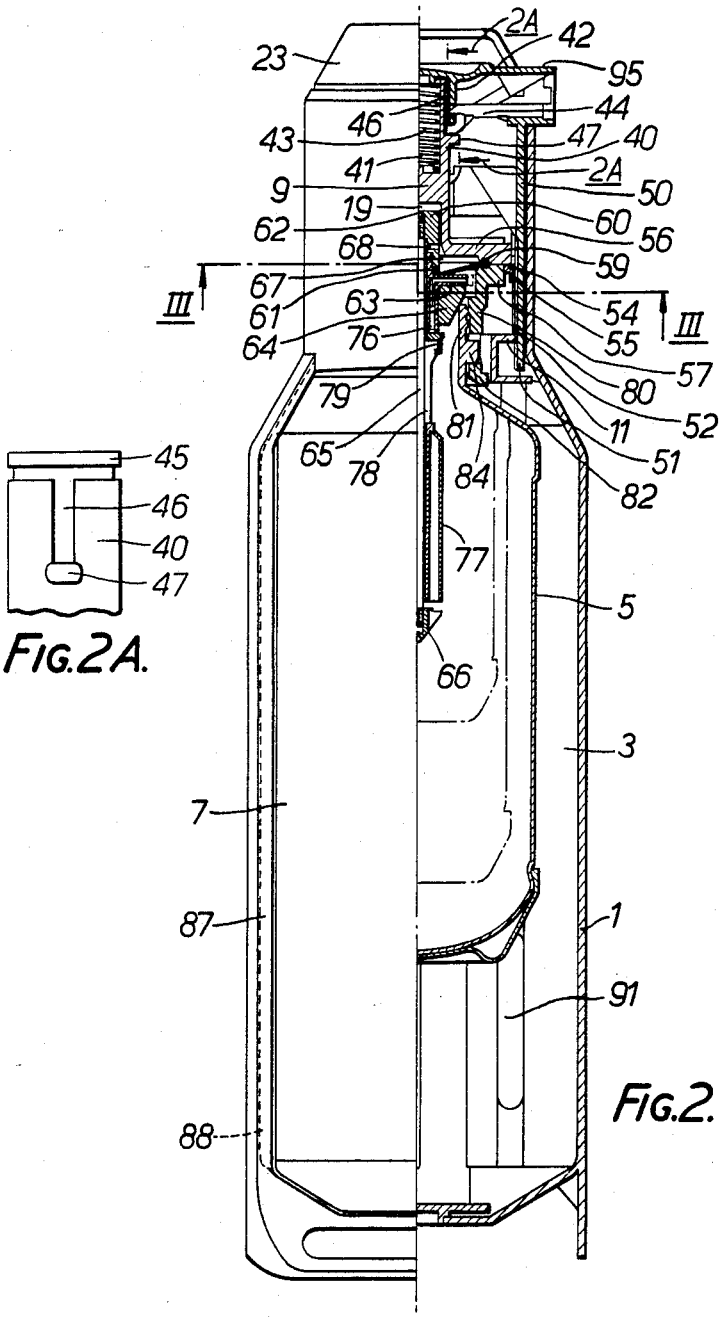
FIG. 2 is a front view of the apparatus with the right hand half shown in cross-section taken along the line II—II of FIG. 1.
FIG. 2A is a side elevational view, at an enlarged scale, taken substantially along the line 2A—2A of FIG. 2.
Figure 3:
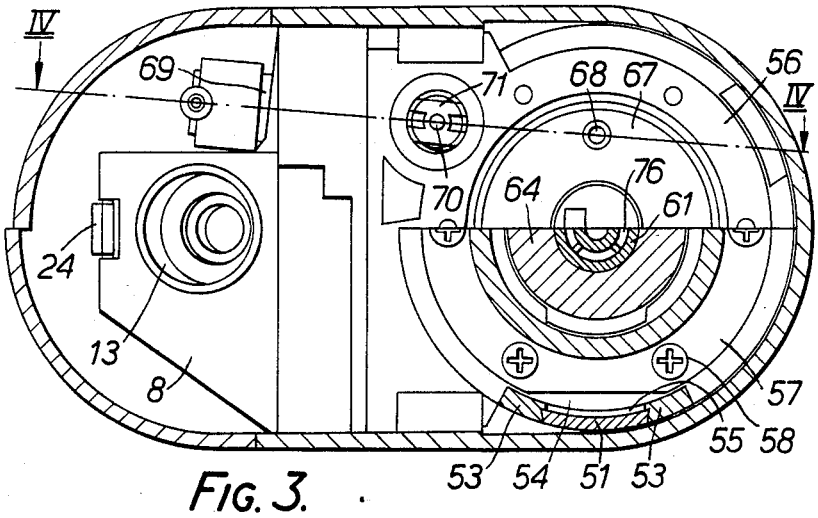
FIG. 3 is a view at an enlarged scale, taken along the line III—III of FIG. 2.

Projecting radially outwardly from the column 40 is an interlock pin 47 (FIGS. 1, 2) which cooperates with axial stop shoulders 48 on the lower end of sleeve 42 to limit rotation of the knob 23 to substantially 180° between a first position, as shown in FIG. 1 and corresponding to an open position of the shield 7 as will become clear, and a second position shown in FIG. 2 when the shield is closed and the key pin 44 is aligned with axial groove portion 46. In this second rotational position of the knob the interlock pin 47 aligns with a longitudinal slot in the sleeve 42 (a lower branch of the key pin 44 extending through the upper end of this slot) so that the knob 23 can be depressed for opening the gas valve 12. In all other rotational positions of the knob, the end face 49 of sleeve 42 abuts against the interlock pin 47 to prevent the knob being pressed down and hence the gas valve being opened.

The knob 23 also has a peripheral skirt 50 with a downwardly projecting finger 51 (FIGS. 2, 3) which engages slidably in a longitudinal slot 52 provided in the upper sleeve 11 of the shield 7 and keys the button 23 to the shield 7 for them to rotate together. At either side of the finger 51 the sleeve 11 has upstanding ears 53 which project into notches provided in a drive ring 54 which is rotatably mounted on the support part 9. The ring 54 has a plurality of lugs 55 spaced apart around its circumference and these lugs are received in complementary notches in the upper edge of the sleeve 11. As a result the knob 23, sleeve 11 and drive ring 54 are fast for rotation in unison and the sleeve 11 is journalled on the support part 9 to rotate about its axis. The interconnection of the knob 23 with the shield 7 and with the main support assembly is so arranged that the interlock pin 47 aligns with the axial slot in the sleeve 42, and the key pin 44 aligns with the axial groove 46 only when the shield covers the opening 6, from which it follows that the knob 23 can be depressed to open the gas valve 12 only when the shield is closed, which is important for ensuring safety of an operator in the event of a bottle burst. The rotation of the knob 23 and shield 7 is facilitated by the radial finger 95 provided on the knob.

Figure 4:
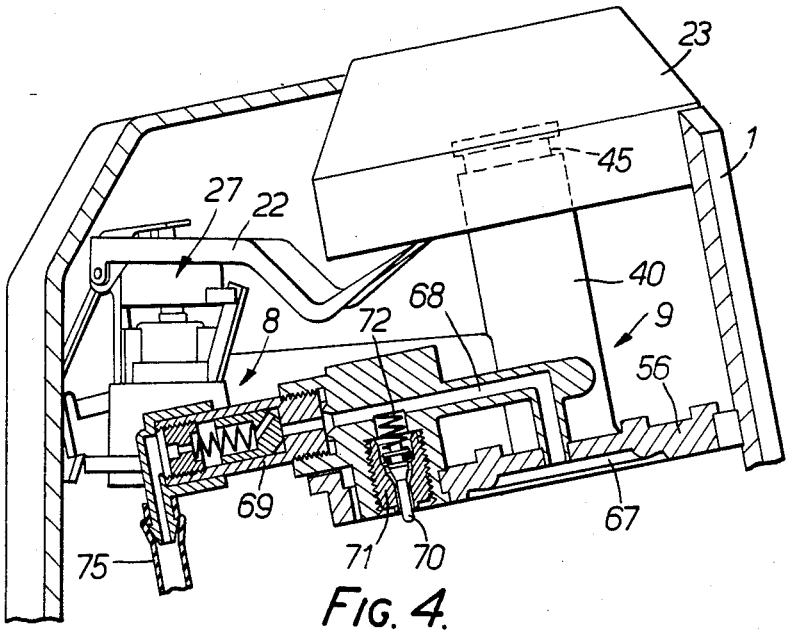
FIG. 4 is a part section taken along the line IV—IV in FIG. 3.
Figure 7:
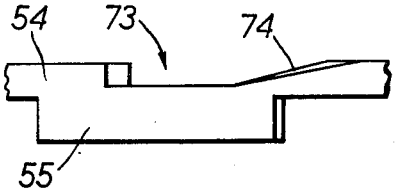
FIG. 7 is an enlarged scale side view illustrating a detail of a drive ring included in the machine of FIGS. 1–4.
Figure 8:
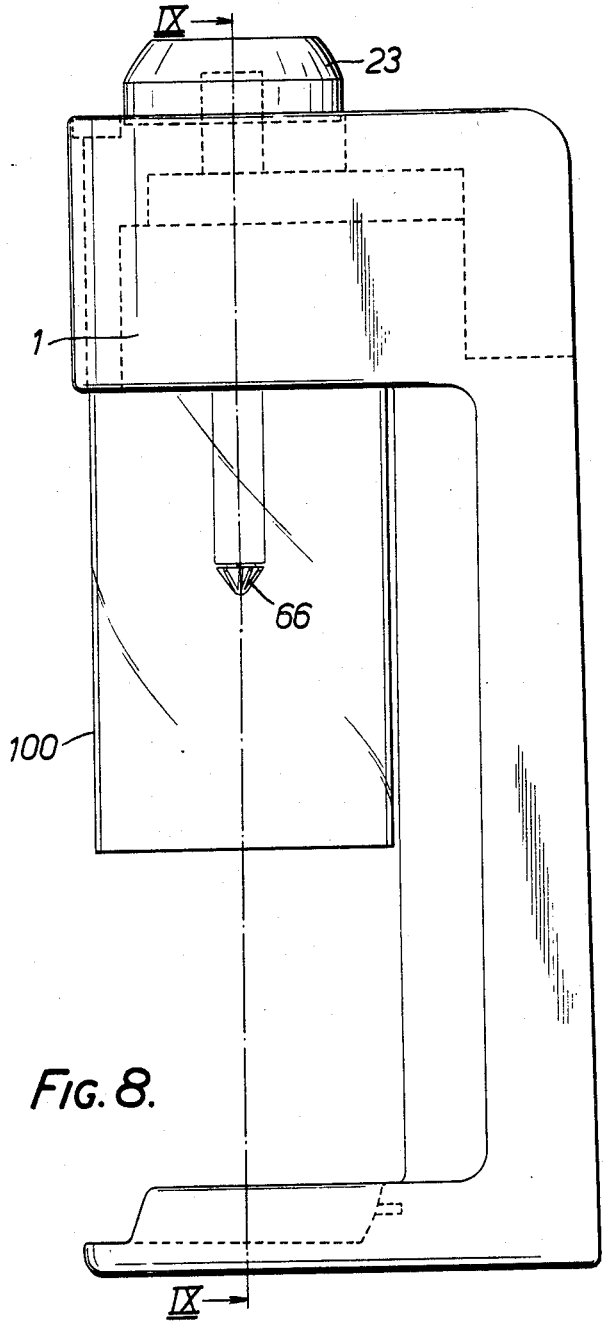
FIG. 8 is a side elevation of another portable carbonating machine embodying the invention.
Figure 9:
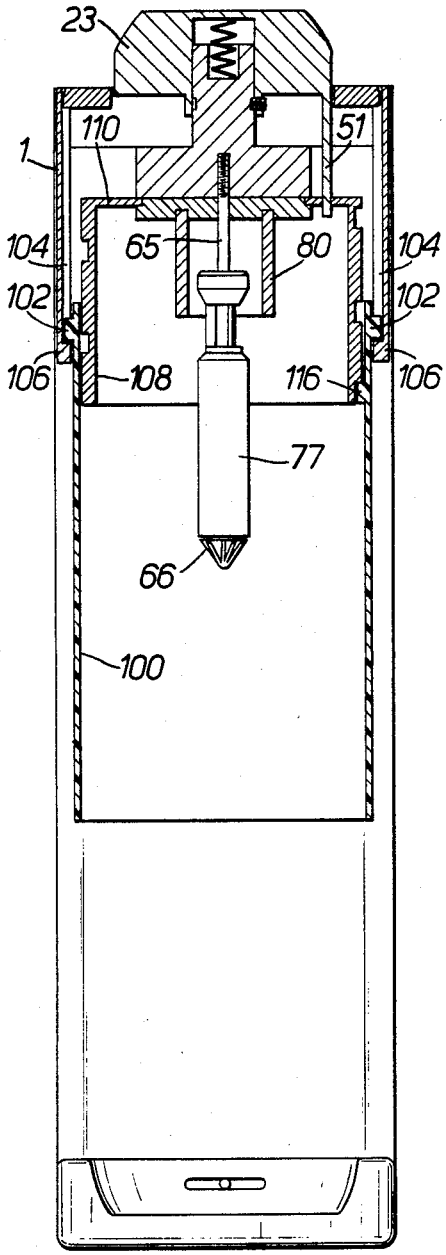
FIG. 9 is a section taken along the line IX—IX of FIG. 8 with some details omitted and others shown only schematically for reasons of clarity.
Figure 10:
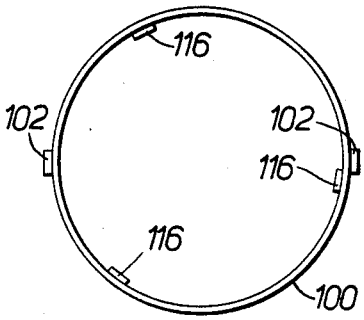
FIG. 10 is a top plan view of the bottle shield tube of FIGS. 8 and 9.
Figure 11:
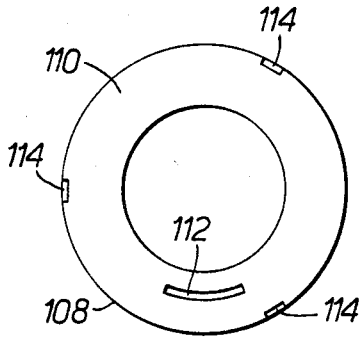
FIGS. 11 and 12 are top plan and side elevation views, respectively, of the drive ring of FIG. 9 provided for the shield tube.
Figure 12:
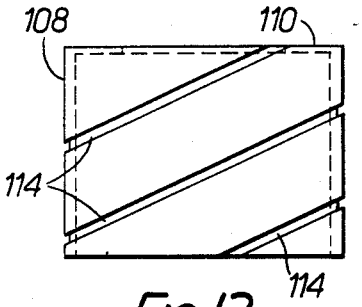

The drive ring 54 is held between axially spaced flanges on upper and lower members 56,57 of the support part 9, the upper member 56 being integral with the column 40. The support members 56,57 are secured together eg. by welding or by screws 58, and clamp between them the outer periphery of an annular diaphragm 59. The inner periphery of the diaphragm is clamped between a piston 60 and a tubular seal carrier 61 which are firmly connected together by a screw threaded connection. The piston 60 has its upper end received slidably in the upper end of the stepped blind bore 19 of support member 56 into which the gas duct 17 opens at the top. Thus, the pressure of the gas delivered into the top of bore 19 through duct 17 acts on the top of the piston 60 and pushes the piston downwardly. The piston has an axial bore which communicates with the bore 19 through a restricted port 62 whereby the gas delivered through duct 17 also enters the piston bore. The seal carrier 61 comprises a tubular element with a flange 63 adapted to underly the diaphragm 59, and carries an annular seal 64 below this flange. A gas tube 65 passes through the bore of element 61 with clearance and has its upper end fitted tightly into the bore of piston 60 by a screw threaded connection, whereby the gas flowing through the port 62 enters this tube 65 and flows down through it to a jet nozzle 66 carried at the lower end of the tube. Confined between the diaphragm 59 and the support member 56 around the piston 60 is a pressure chamber 67 and a plurality of radial holes 68 in the piston communicate this chamber with the annular passage defined by the radial clearance between the seal carrier 61 and the gas tube 65. Also communicating with the chamber 67 is an exhaust duct 68 (FIGS. 3 and 4) which leads to a pressure relief valve 69 of known type mounted on the support assembly. A discharge port intersects the duct 68 and is normally closed by a gas pressure release valve member 70 which is urged towards its seat 71 by a spring 72. The valve member 70 projects from the port for cooperation with the upper surface of the drive ring 54. As shown in FIG. 7, this top surface includes a recess 73 with a ramp 74 which in response to rotation of the shield is adapted to push the valve member 70 upwardly whereby the discharge port is opened to release the gas pressure in chamber 67. The recess 73 is so positioned on the ring 54 that the discharge valve is closed when the shield 7 is closed, the valve is opened by the ramp 74 as soon as the shield starts to rotate from this position to open the front of the casing. As shown in FIG. 4 a tube 75 may be attached to the outlet of the relief valve 69 to conduct any moisture escaping through this valve to a drip tray via a port 90 in the rear wall of chamber 3.

The seal carrier 61 incorporates a vent 76 (FIG. 2) having an annular inlet opening through a valve seat at the lower end of the carrier 61, and a pair of diametrically opposed outlets opening to atmosphere at the periphery of the flange 63. Slidable on the gas tube 65 is an annular float 77. Mounted on the upper end of the float by longitudinal webs 78 is a valve seal 79 adapted to seal against the seat at the lower end of carrier 61 and thus close off the vent 76 when the float 77 is raised.

The lower support member 57 includes a downwardly projecting cylindrical collar 80 adapted to receive and support the neck 81 of the bottle 5, the lower end of this collar having a peripheral ring 82 to assist in guiding the rotation of the sleeve 11 of the shield 7. The bottle neck includes a screw thread at its upper end for attaching a closure, and a plurality, e.g. four, radially projecting lugs 84 uniformly distributed around the neck. The collar 80 has a corresponding number of bayonet slots 85 (FIG. 1) with which the lugs cooperate so that in response to an upward twisting motion of the bottle 7 the bottle becomes suspended from the main support assembly of the machine. When mounted in the machine the bottle is supported completely by the lugs 84 on the neck. The lugs 84 are conveniently formed on the neck by injection moulding or extrusion blow this part of the bottle. The upper surfaces of the bayonet slots 85 are preferably inclined at such a steep angle that they tend to cam the lugs 84 into the locking position as the bottle neck is pushed up into the support collar 80. Because the bottle is supported by the neck the machine will accept bottles of different capacities, as illustrated in the dashed lines in FIG. 2, provided of course they have the correct neck configuration.

The operation of the machine will now be described. With the shield 7 in the open position, the bottle 5 previously filled with water to a predetermined level is inserted into the chamber 3 through the casing opening 6 and is lifted with a twisting action to engage the lugs 84 with the bayonet slots 85 and hence fix the bottle in position. The gas tube 65 and nozzle 66 extend down into the bottle through the neck and provided there is sufficient liquid in the bottle the float 77 will be lifted to push the valve seal 79 against its seat and close the vent passages 76. If the bottle is empty or contains too little water the float 77 will not close the vent and any gas subsequently delivered to the bottle can escape directly to atmosphere through the vent passage and pressure will be prevented from building up in the bottle.

When the bottle is being loaded the seal 64 is retracted under the natural resilience of the diaphragm 59. In this position the diaphragm will be substantially flat and the top of piston 60 will be close to the top end wall of bore 19. There will be a small axial clearance between the top of the bottle neck and the seal member 64 so there is no risk of the seal member being harmed on loading the bottle into the machine. Before any gas can be introduced into the bottle the knob 23 must be rotated to close the cover shield 7 and thereby bring the interlock pin 47 into cooperation with the axial slot in the sleeve 42, and bring the key pin 44 into alignment with the groove 46. The knob 23 can then be depressed to open the gas valve 12 through lever 22 and pin 14, provided of course that the machine is substantially upright and the ball 30 occupies its central position for transmitting the thrust force from the lever 22 to the pin 14 so that the gas valve is opened. When the gas valve is opened the first burst of gas passes through duct 17 and enters the cavity above piston 60 and the pressure of the gas drives this piston downwardly thereby moving the seal 64 into firm sealing engagement with the rim of the bottle neck. The gas then flows through the restricted port 62 of the piston 60 and passes down through the gas tube 65 to be injected into the water contained in the bottle 5 through the nozzle 66. Some gas dissolves in the liquid while some bubbles up through the liquid into the ullage space above the liquid in the bottle, and from this space the gas passes through the annular passage between the seal carrier 61 and gas tube 65 and through the ports 68 into the chamber 67 above the diaphragm. As the pressure in the bottle increases so does that in the chamber 67, whereby due to the differential areas exposed to the pressure on the top of the diaphragm and on the underside of the seal member 64, the seal member is pressed into stronger sealing abutment with the bottle neck. As gas continues to be supplied, ideally in a series of short bursts, the pressure rises until the relief valve 69 opens to prevent any further increase and also to provide an audible signal indicating that the water has been adequately carbonated. To remove the bottle of carbonated liquid the knob 23 is rotated in the direction to open the cover shield 7. Almost immediately the ramp surface 74 on the drive ring engages the discharge valve member 70 and pushes this member upwardly to open the discharge port thereby releasing to atmosphere the pressure in chamber 67 and hence in the gas space above the liquid in the bottle. With the pressure removed the diaphragm 59 moves the piston 60 back to the initial position and withdraws the seal 64 from the bottle neck. When the shield has been opened fully the bottle 5 can be disengaged from the support assembly by releasing the bayonet connection 84,85 and removed from the chamber 3 through the opening 6. The bottle cannot be removed until the pressure in chamber 67 has been fully released since this pressure acts on the top of the bottle through the seal 64 to lock the bayonet lugs in their slots.

The cover shield 7 is arranged so that it will not be blown away from the casing 1 if a bottle should burst in the machine, for example due to the machine being operated with a damaged or faulty bottle. At the sides of the opening 6 the casing is provided with inturned lips 87, and the cover shield 7 is provided at its side edges with out-turned lips 88 which engage behind the lips 87 when the shield is in the closed position. If the shield 7 is subjected to a sudden pressure increase in chamber 3 tending to drive it away from the casing 1, the lips 87, 88 will come into abutment to retain the cover shield in position on the casing. As shown in FiGS. 1 and 2, the rear wall of chamber 3 is provided with slots 91 for leading away to atmosphere any pressure build up in this chamber.

Various modifications are possible to the machine as described above without departing from the inventive concepts embodied within it. For example, in place of the diaphragm 59 a piston urged upwardly by a light spring could be used. Furthermore, instead of a piston actuated by the gas to drive down the seal into cooperation with the bottle a mechanical device could be used, such as a helical cam arrangement actuated by rotation of the knob 23 or the shield 7.

The portable carbonating machine illustrated in FIGS. 8 to 12 has for the most part essentially the same basic construction and operation as that described above and the same reference numerals have been used to designate corresponding parts of the two embodiments, and only the main modifications are described in detail below.

Instead of the casing defining a chamber to receive the bottle, the machine is provided with a shield tube 100 e.g. of transparent or translucent plastics material, which substantially encloses the bottle during carbonation of the liquid in the bottle. The machine casing 1 and main support assembly are so arranged that the gas supply tube 65 carrying the injection nozzle 66 projects substantially vertically downwards. The shield tube 100 is mounted coaxially around the gas tube 65 and is guided for upward vertical movement relative to the casing by a pair of diametrically opposed pegs 102 on the shield tube engaging in respective vertical grooves 104, provided on the casing. The grooves 104 are closed at their lower ends to define stops 106 limiting the downward movement of the shield tube 100 to the position shown in FIGS. 8 and 9.

A drive ring 108 is included for displacing the shield tube up and down relative to the casing. As its upper end the ring 108 has an inner flange 110 by means of which the ring is journalled on the main support assembly of the machine for rotation about the axis of the gas tube 65. The flange 110 includes a slot 112 in which a tongue or finger 51 depending from and integral with the operating button 23 engages so that the drive ring 108 is rotated with the knob 23. As described for the previous embodiment, the knob 23 may be depressed to open a gas valve to supply gas to the injection nozzle 66, but an interlock (not shown) between the knob 23 and the main support assembly allows the knob to be pressed only in one predetermined position of rotation of the knob. This predetermined position will be when the shield is in the lowermost position as depicted in FIGS. 1 and 2.

On the outer cylindrical surface of the drive ring 108 are three equispaced helical grooves 114, which form guide slots for three pegs 116 projecting on the inner surface of the shield tube 100. Thus, as the guide ring 108 is turned with the operating knob 23, the shield tube 100 is driven up and down relative to the casing 1, it being held against rotation with the ring 108 due to the engagement of the pegs 102 in grooves 104.

In use of the machine, the shield tube 100 is raised to a position in which its lower edge is located slightly below the nozzle 6, to enable a bottle to be introduced through the open bottom end of the tube 100 and be engaged with the bottle support member 80. This upward displacement of the shield tube is achieved by turning the knob 23, and as soon as the shield tube is lifted from the lowermost position the interlock between the support assembly and the knob 23, prevents the latter being pressed to operate the gas valve. When the bottle is mounted in the proper position, the shield tube is lowered by reverse rotation of the knob 23, and on reaching the bottom position determined by the stops 106 the knob 23 can be pressed for carbonating the water in the bottle. On completion of the carbonating process the bottle of carbonated water can be removed from the machine after raising the shield tube again in the same manner as described above. In a preferred arrangement the knob 23 is rotatable through about 180° to move the shield between its top and bottom positions.

The shield tube substantially encloses the bottle during the carbonation of the liquid in the bottle and serves to protect the user by directing any gas or liquid escaping, e.g. due to a machine malfunction or a bottle breaking, downwardly through the open end of the tube. The base of the machine may include a drip tray located below the shield tube to catch any liquid spilled or leaking from the machine.

It will be appreciated that these are several alternative arrangements which could be used for displacing the shield tube up and down in response to rotation of the operating knob.

We claim:

1. An apparatus for carbonating liquid contained in a bottle having a neck, comprising sealing means for engaging and sealing the neck of the bottle, gas supply means, gas injecting means connected to the gas supply means and projecting downwardly from the sealing means for injecting gas into the liquid, support means for supporting the bottle in a predetermined position with the neck of the bottle uppermost and adjacent to said sealing means, the gas injecting means being arranged to extend down into the liquid in the bottle when the bottle is supported by the support means, movable wall means carryiing the sealing means, a chamber defined on the side of the movable wall means remote from the sealing means, wall displacing means operable to displace the movable wall means and the sealing means downwardly for moving the sealing means either before or as gas is first injected into the bottle, from a position spaced above the bottle neck to a position of firm sealing engagement with said neck.

2. An apparatus according to claim 1, wherein the wall displacing means is responsive to an initial burst of gas supplied from the gas supply means to the gas injecting means to displace the sealing means downwardly to engage the neck.

3. An apparatus according to claim 2, wherein the wall displacing means comprises a member having an upper surface, an enclosed space communicates with the gas injecting means, and said upper surface is acted upon by the gas pressure in said space, whereby said member is movable downwardly under the pressure of gas in said space.

4. An apparatus according to claim 3, wherein said space communicates with the gas injecting means through a restricted port, and said space is connected to the gas supply means for gas to be supplied to the injecting means via said space and said port.

5. An apparatus according to claim 4, wherein a stationary support is provided and includes a bore, and said member is a piston slidable in the bore.

6. An apparatus according to claim 5, wherein the gas injecting means comprises a gas tube having an upper end connected to the piston, and the restricted port is provided in the piston for gas to be supplied to the upper end of the gas tube from said gas space through said port.

7. An apparatus according to claim 6, wherein the movable wall means comprises a diaphragm and is connected to the piston for returning the piston to an upper position in the bore when the gas pressure in said space is released.

8. An apparatus according to claim 7, wherein the piston has a tubular seal carrier connected thereto, the sealing means comprises a seal member supported on said tubular carrier, the diaphragm is annular and has the inner periphery thereof held between the seal carrier and piston, and the outer periphery of the diaphragm is sealed to the stationary support.

9. An apparatus according to claim 1, wherein the support means for supporting the bottle is adapted to support the bottle by the neck.

10. An apparatus according to claim 9, wherein the support means for supporting the bottle comprises a collar surrounding the gas injecting means adjacent the sealing means and having a bayonet type of coupling with the bottle.

11. An apparatus according to claim 10, wherein the collar comprises a plurality of bayonet slots engageable by respective radial projections on the outer surface of the bottle neck.

12. An apparatus according to claim 11, wherein the bayonet slots have inclined edges for camming the bottle projections into locking engagement with the collar in response to upward movement of the bottle neck into the collar.

13. A bottle for use in combination with the liquid carbonating apparatus of claim 12, comprising a neck portion with a plurality of integral protrusions spaced apart around the neck portion and projecting laterally outwardly therefrom for co-operation with rspective bayonet slots of the bottle supporting means of the carbonating apparatus.

14. A bottle according to claim 13, wherein the bottle is made of plastics material and the neck portion is shaped by moulding.

15. A portable liquid carbonating apparatus comprising means for injecting gas into a body of liquid contained in a carbonating vessel, gas supply means for conducting gas to the injecting means from a pressurised gas source, valve means included in the gas supply means for controlling the flow of gas therethrough, and disabling means arranged to prevent the valve means being opened if the apparatus is inclined to a normal operating position in which it is intended to be used by more than a given angle.

16. An apparatus according to claim 15, wherein the disabling means prevents the valve means being opened if the apparatus is inclined to the normal position by more than 20°.

17. An apparatus according to claim 16, wherein a valve actuating member is displaceable to open the valve means, and the disabling means is arranged to block displacement of the valve actuating member to prevent the valve means being opened when the apparatus is inclined by more than the given angle.

18. An apparatus according to claim 17, wherein the disabling means comprises a pendulum suspended from the valve actuating member and adapted to engage a fixed stop to prevent the actuating member being displaced to open the valve means.

19. An apparatus according to claim 17, wherein the disabling means comprises a force transmitting member interposed between the valve actuating member and the valve means for transmitting a valve opening force from the actuating member to the valve means, the force transmitting member being arranged to be moved out of force transmitting engagement between the actuating member and valve means when the apparatus is inclined by more than the given angle.

20. An apparatus according to claim 19, wherein the force transmitting member is a thrust transmitting ball.

21. An apparatus according to claim 20, wherein the ball is retained in a cage, the valve means includes a valve operating pin, the cage being attached to an upper end of the pin, the ball normally resting against the end of said pin, and an element is movable by the valve actuating member to press down on to the ball and the pin for opening the valve means.

22. An apparatus according to claim 21, wherein the cage includes a base having a concave upper surface, the base defining with the upper end of the pin a shallow recess having a peripheral step, the ball being located in the recess in the normal position of the apparatus and being adapted to roll out of said recess when the apparatus is inclined by more than the given angle.

23. An apparatus for carbonating liquid contained in a bottle having a neck, comprising sealing means for engaging and sealing closed the neck of the bottle, and gas injecting means extending downwardly from the sealing means for injecting gas into the liquid, a vent passage defined through the sealing means for communicating the interior of the bottle with atmosphere when the sealing means is engaged with the bottle neck, and valve means responsive to the level of liquid in the bottle and arranged to close the vent passage when a predetermined level of liquid is present in the bottle.

24. An apparatus according to claim 23, wherein the valve means is operated by a float.

25. An apparatus according to claim 24, wherein the gas injecting means includes a gas tube and the float is guided for movement along the gas tube.

26. An apparatus according to claim 25, wherein the vent passage has an inlet surrounded by a seat and the float carries a seal member for engaging the seat to close the vent passage.

27. An apparatus according to claim 26, wherein the sealing means comprises an annular seal member, the seal member is supported by a tubular carrier, and said vent passage extends through the wall of said carrier.

28. An apparatus for carbonating liquid contained in a bottle, comprising a casing defining an enclosure for receiving the bottle, said enclosure including a movable wall member which is adjustable between a first position enabling the bottle to be introduced into and removed from the enclosure and a second position in which the bottle is substantially enclosed, sealing means for engaging and sealing closed the neck of a bottle received in the enclosure, gas injecting means extending downwardly from the sealing means for injecting gas into the liquid in the bottle, gas supply means for conducting gas to the injecting means from a pressurised gas source valve means included in the gas supply means to control the flow of gas to the injecting means, valve actuating means operable to open the valve means, and interlock means coupled between said movable wall of the enclosure and the valve actuating means, said interlock means permitting the valve means to be opened only when the movable wall is in the said second position.

29. An apparatus according to claim 28, wherein the valve actuating means comprises a manually operable member, and said manually operable member is coupled to the movable wall for adjusting said wall between the first and second positions.

30. An apparatus according to claim 29, wherein the manually operable member is rotatable relative to the casing for adjusting the position of the movable wall, and said member is displaceable relative to the casing in a different manner of said rotation for actuating the valve means.

31. An apparatus according to claim 30, wherein the manually operable member comprises a knob and is arranged to be depressed to open the valve means.

32. An apparatus according to claim 31, wherein the knob is mounted for rotation and axial sliding movement on a support fixed relative to the casing, and the interlock means comprises a projecting element fixed to one of said knob and support and co-operating with a recess in the other of the knob and support to permit axial movement of the knob in one rotational position only, and to permit rotational movement of the knob only if the knob is not depressed.

33. An apparatus according to clam 29, wherein an exhaust valve is provided and is operable to release the gas pressure in the bottle, and an exhaust valve operating member is so coupled to said movable wall member that the exhaust valve is closed when the movable wall is in said second position, and is opened upon adjustment of the movable wall member from said second position towards said first position.

34. An apparatus according to claim 33, wherein the exhaust valve operating member is fast for rotation with the manually operable member.

35. An apparatus according to claim 28, wherein the movable wall member of the enclosure comprises a tubular shield which is raised and lowered between the said first and second positions.

36. An apparatus according to claim 29, wherein the casing defines a chamber with a side wall opening, and the movable wall member comprises a cover shield rotatable relative to the casing between said first and second positions to open and close the opening.

37. An apparatus according to claim 36, wherein the cover shield is journalled for rotation coaxially with the manually operable member.

38. An apparatus according to claim 37, wherein the cover shield comprises a sleeve at the upper end thereof, the sleeve being rotatably supported around a fixed support, said support carrying said sealing means and said manually operable member.

* * * * *